US012478205B2

(12) United States Patent
Crenshaw

(10) Patent No.: US 12,478,205 B2
(45) Date of Patent: Nov. 25, 2025

(54) TREE CAPE AND METHOD OF USING

(71) Applicant: Andrae Crenshaw, Lithia Springs, GA (US)

(72) Inventor: Andrae Crenshaw, Lithia Springs, GA (US)

( * ) Notice: Subject to any disclaimer, the term of this patent is extended or adjusted under 35 U.S.C. 154(b) by 1008 days.

(21) Appl. No.: 17/079,416

(22) Filed: Oct. 23, 2020

(65) Prior Publication Data

US 2021/0120993 A1 Apr. 29, 2021

Related U.S. Application Data

(60) Provisional application No. 62/925,001, filed on Oct. 23, 2019.

(51) Int. Cl.

| | |
|---|---|
| ***A47G 33/08*** | (2006.01) |
| ***A47G 33/04*** | (2006.01) |
| ***B65D 65/08*** | (2006.01) |
| ***B65D 85/52*** | (2006.01) |

(52) U.S. Cl.

CPC ..... *A47G 33/08* (2013.01); *A47G 33/045* (2013.01); *A47G 33/0863* (2013.01); *B65D 65/08* (2013.01); *B65D 85/52* (2013.01)

(58) Field of Classification Search

CPC ..... A47G 33/04; A47G 33/045; A47G 33/08; A47G 33/0863; B65D 65/04; B65D 65/08; B65D 85/50; B65D 85/52; B65F 2240/124; A01G 13/043; A41D 3/08

USPC ..... 150/154; 206/423; 428/7, 9, 18; 2/88

See application file for complete search history.

(56) References Cited

U.S. PATENT DOCUMENTS

| | | | | |
|---|---|---|---|---|
| 154,278 | A * | 8/1874 | Popovits | A41D 3/08 2/88 |
| 1,398,165 | A * | 11/1921 | Whiteside | A41D 3/08 2/202 |
| 2,714,776 | A * | 8/1955 | Lee | B65D 85/04 428/7 |
| 2,781,811 | A * | 2/1957 | Dilar et al. | A47G 33/045 206/423 |
| 3,676,275 | A * | 7/1972 | Sloane | A47G 33/0863 428/19 |
| D349,469 | S * | 8/1994 | Mitchell | D11/130 |

(Continued)

FOREIGN PATENT DOCUMENTS

| | | | | |
|---|---|---|---|---|
| DE | 202006012419 | U1 * | 11/2006 | A47G 33/045 |
| DE | 202013103408 | U1 * | 10/2013 | A47G 33/045 |

(Continued)

OTHER PUBLICATIONS

Joy, "How to Make a DIY Tulle Canopy in 6 simple steps", Apr. 10, 2019, "Joyful Derivatives DIY + Home", URL: <https://joyfulderivatives.com/how-to-make-a-tulle-canopy/>, pp. 1-25 (Year: 2019).*

(Continued)

*Primary Examiner* — Stephen F. Gerrity

(74) *Attorney, Agent, or Firm* — Charlena Thorpe, Esq.; Incorporating Innovation LLC

(57) ABSTRACT

Implementations of a tree cape having one or more sleeve portions, a neck portion, and one or more openings are provided. Methods of using a tree cape include positioning the neck portion of the tree cape at or adjacent to the top portion of a tree, and further positioning the tree cape over and around the tree to cover the tree.

8 Claims, 19 Drawing Sheets

(56) References Cited

U.S. PATENT DOCUMENTS

| | | | | |
|---|---|---|---|---|
| 9,215,945 | B2 * | 12/2015 | PeCoy | A47G 33/04 |
| 10,251,504 | B1 * | 4/2019 | Sutton et al. | B65F 1/002 |
| 2006/0105119 | A1 * | 5/2006 | Sanford et al. | A47G 33/06<br>428/18 |
| 2007/0227925 | A1 * | 10/2007 | Westrate | B65D 85/52<br>206/423 |
| 2021/0169154 | A1 * | 6/2021 | Bergonio | A41D 31/04 |
| 2021/0259165 | A1 * | 8/2021 | Rauch et al. | A41D 15/04 |

FOREIGN PATENT DOCUMENTS

| | | | | | |
|---|---|---|---|---|---|
| EP | 1867578 | A1 * | 12/2007 | | B65D 65/08 |
| JP | H01137002 | U * | 9/1989 | | |
| JP | 2017144100 | A * | 8/2017 | | |

OTHER PUBLICATIONS

Gianina Lindsey, 2013 Festival of Trees, www.flickr.com/photos/gianinal/11021437793, Nov. 24, 2013, 2 pages. (Year: 2013).*

FaceCebu.Net, Christmas Trees Around Cebu, www.facecebu.net/2011/12/christmas-trees-around-cebu.html, Oct. 28, 2018, 6 pages. (Year: 2018).*

* cited by examiner

TREE CAPE AND METHOD OF USING

CROSS REFERENCE TO RELATED APPLICATION

This application claims the benefit of U.S. Patent Application Ser. No. 62/925,001, which was filed on Oct. 23, 2019, and is incorporated herein by reference in its entirety.

TECHNICAL FIELD

This disclosure relates to implementations of a tree cape.

BACKGROUND

Artificial (synthetic, faux, etc.) Christmas trees, such as shown in FIG. 1, or similar artificial or real trees, shrubs, etc. ("trees") are popular and desirable for convenience, variety, and reusability. For example, such trees are often placed in homes or other locations for decorative, symbolic, or other purposes. However, there does not currently exist a cape-like cover to provide a decorative covering to such trees, and/or to provide a protective and/or concealing cover to such trees.

DETAILED DESCRIPTION

Implementations of a tree cape are provided. In some implementations, the tree cape comprises one or more sleeve portions, a neck portion, and one or more openings. In some implementations, the tree cape may further comprise trim.

In some implementations, the tree cape is configured to provide a decorative cover to artificial (synthetic, faux, etc.) Christmas trees or similar trees, shrubs, etc. ("trees"), including real or non-artificial Christmas trees or other trees. In some implementations, the tree cape is configured to provide such cover in a form that is similar to a clothing cape.

In some implementations, the tree cape is configured to add or enhance a decorative appearance of such trees. In some implementations, the tree cape is configured to provide such decorative appearance while showing at least a portion of such trees through the material composing the tree cape. In some implementations, the tree cape is configured to provide such decorative appearance while showing at least a portion of such trees through one or more openings of the tree cape.

In some implementations, the tree cape may be configured to provide a protective cover to such trees, e.g. from dust, debris, moisture, etc. In some implementations, the tree cape may be configured to provide such protective cover for non-use, storage, etc. of such trees.

In some implementations, the tree cape may be configured to provide a concealing cover to such trees, e.g. to conceal or hide the trees from view. In some implementations, the tree cape may be configured to provide such concealing cover for non-use, storage, etc. of such trees.

In some implementations, a method of using the tree cape comprises positioning the neck portion of the tree cape at or adjacent to the top portion of a tree, and further positioning the tree cape over and around the tree to cover the tree accordingly.

Figure 1:
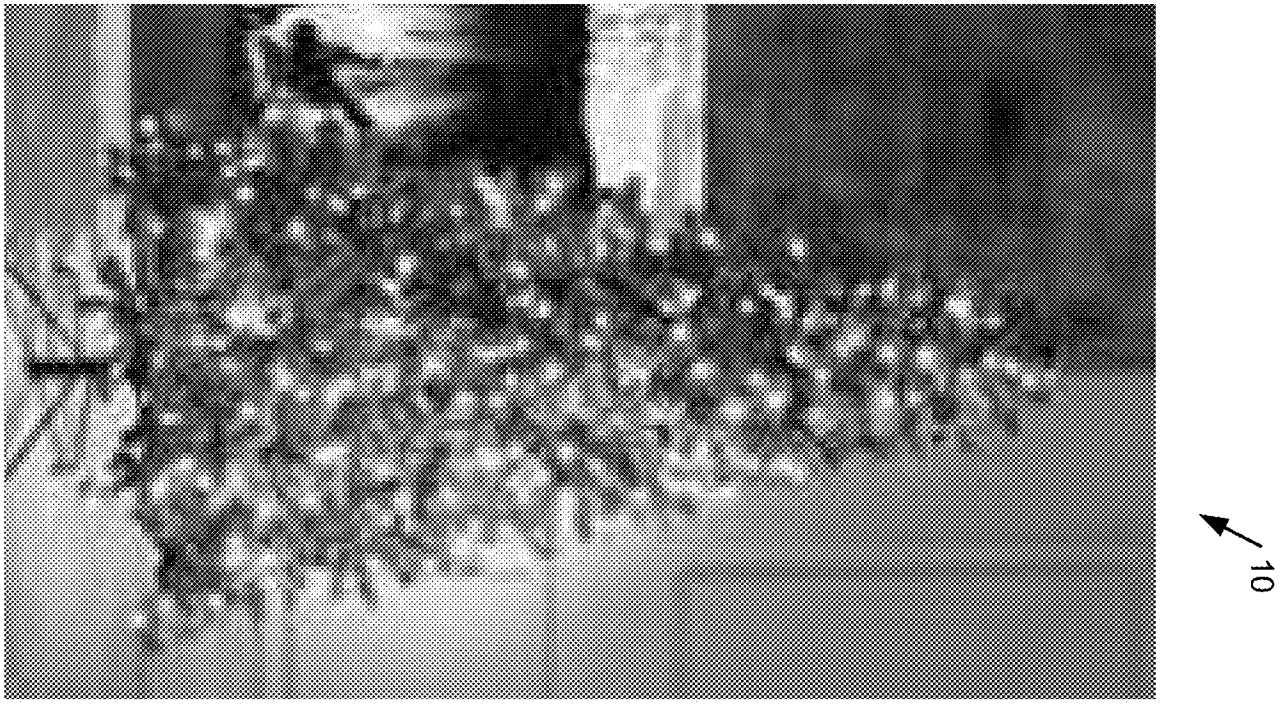
FIG. 1 (Prior Art)
FIG. 1 illustrates an example existing artificial Christmas tree.

FIG. 1 illustrates an example existing artificial Christmas tree 10. Artificial (synthetic, faux, etc.) Christmas trees 10, such as shown in FIG. 1, or similar trees, shrubs, etc. ("trees") are popular and desirable for convenience, variety, and reusability. For example, such trees 10 are often placed in homes or other locations for decorative, symbolic, or other purposes.

Figure 2A:
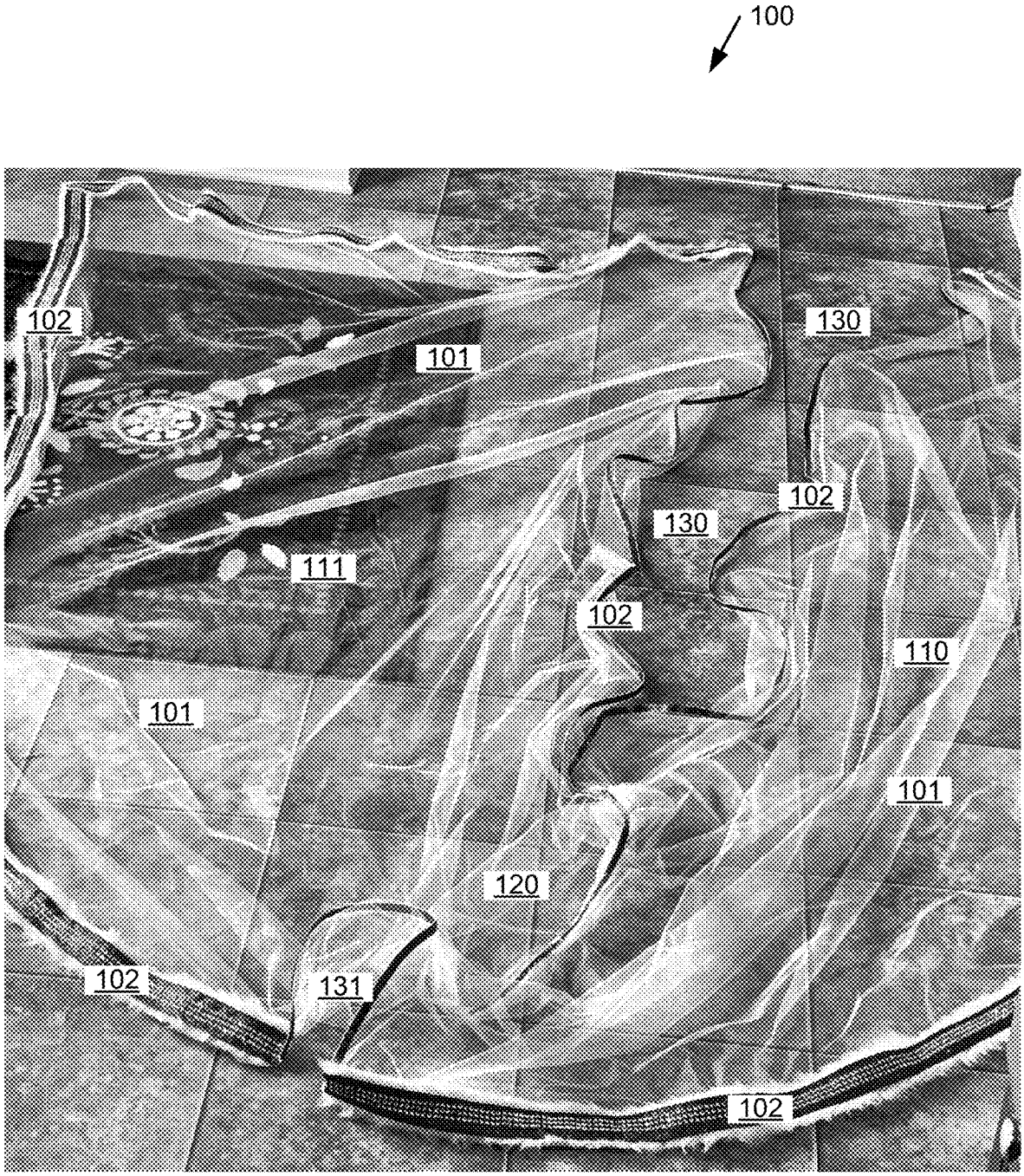
FIGS. 2A-2C illustrate implementations of an example tree cape according to the present disclosure.
Figure 2B:
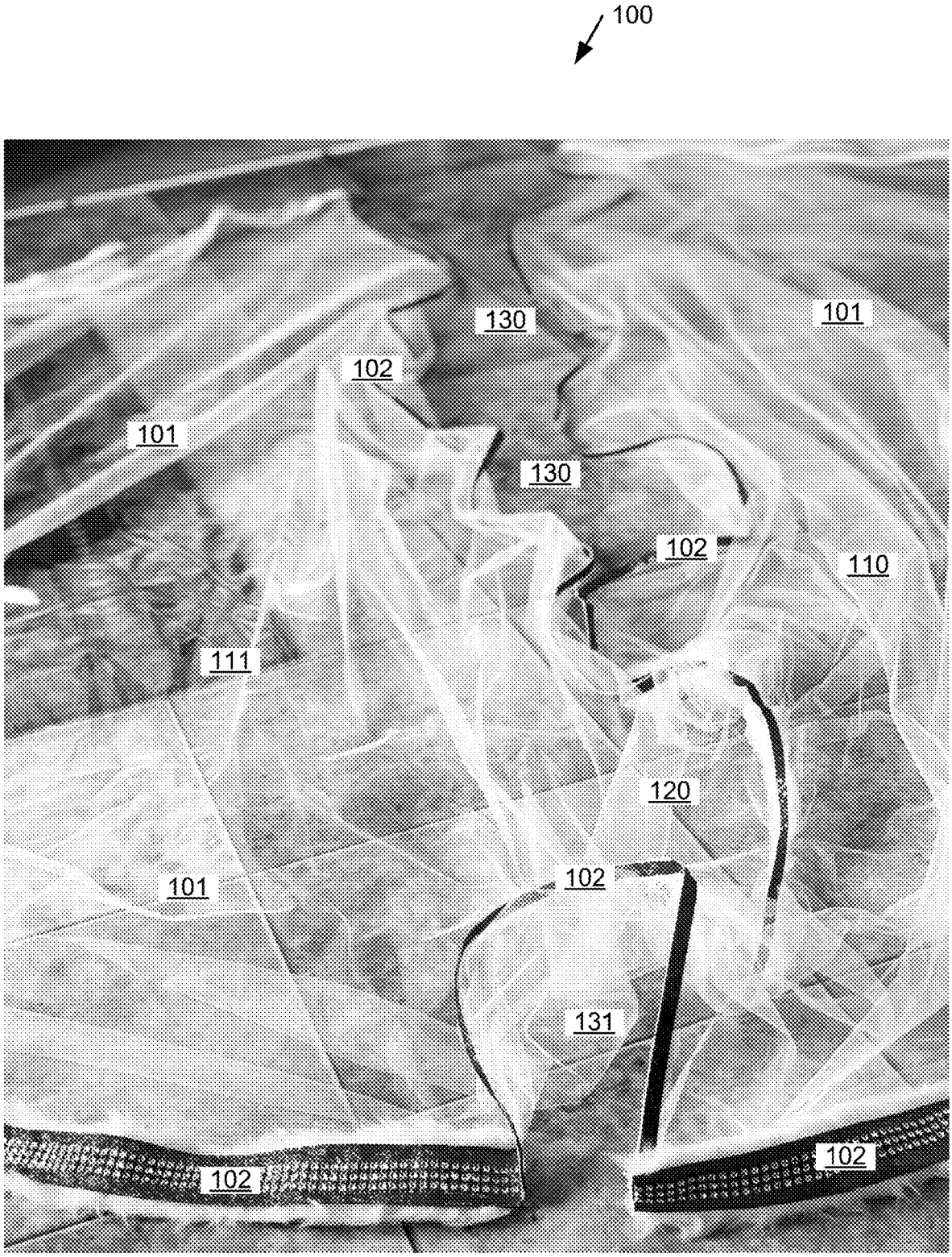
Figure 2C:
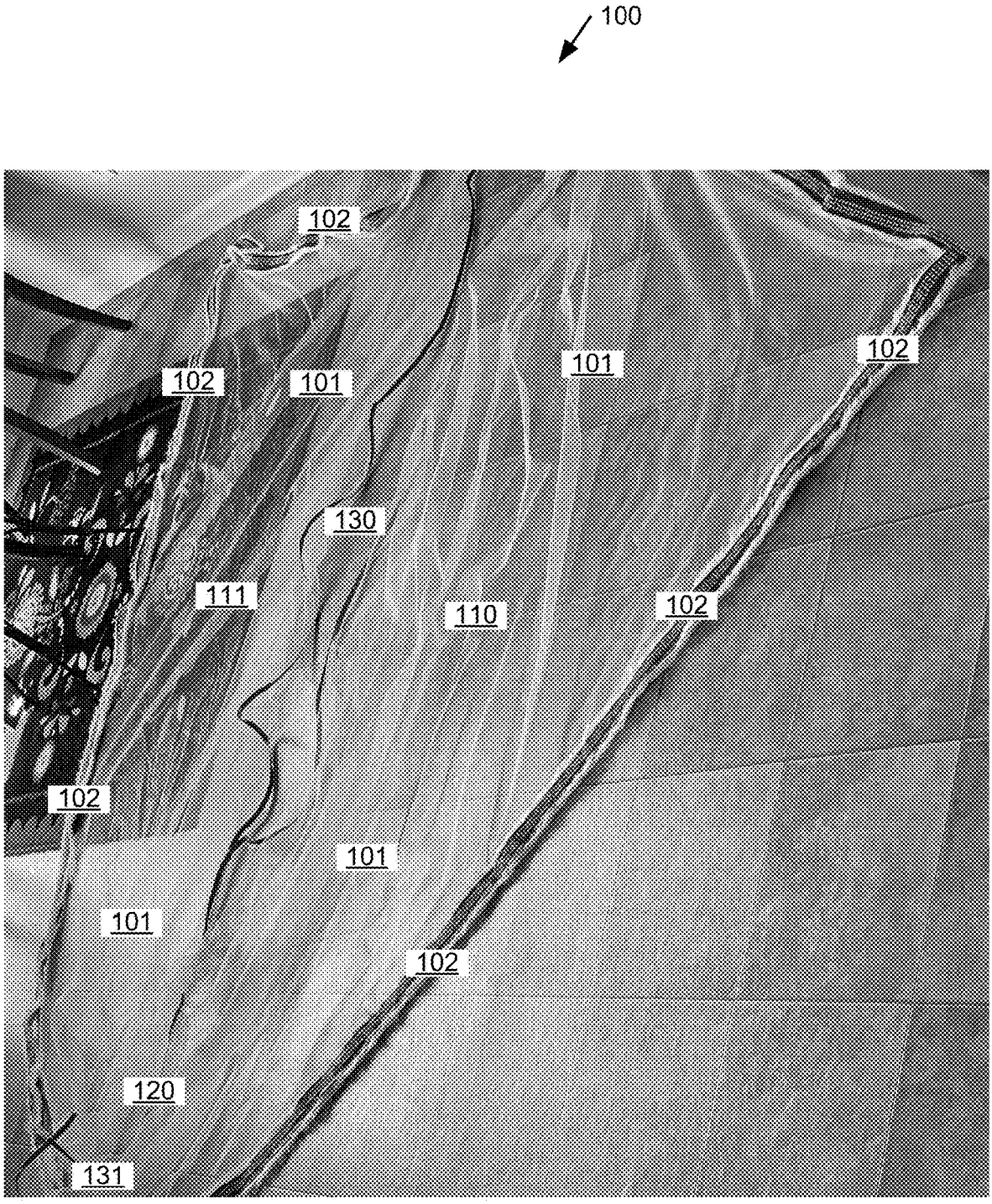
Figure 3:
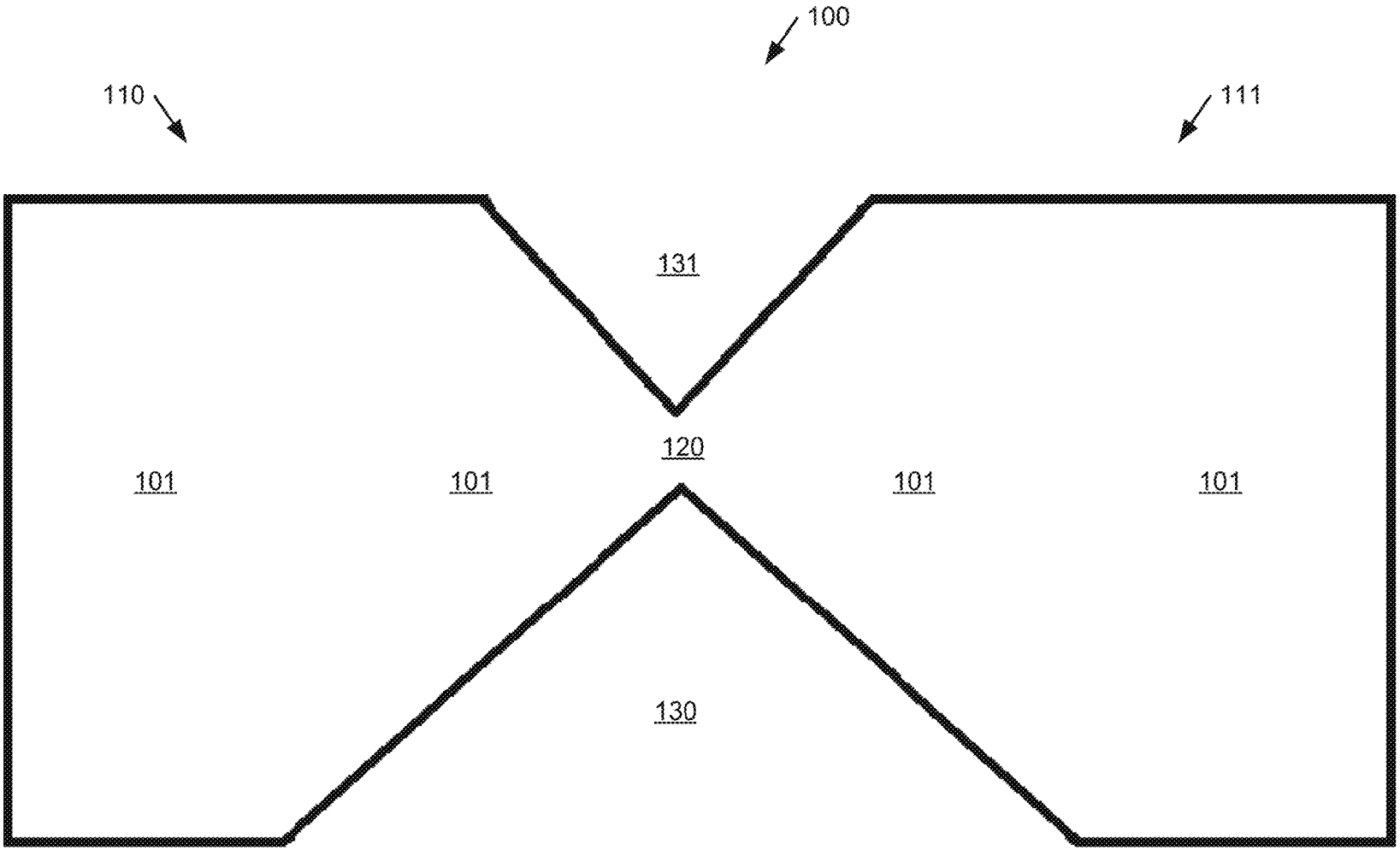
FIG. 3 illustrates a diagram representation of the example tree cape illustrated in FIGS. 2A-2C.

FIGS. 2A-2C illustrate implementations of an example tree cape 100 according to the present disclosure. FIG. 3 illustrates a diagram representation of the example tree cape 100 illustrated in FIGS. 2A-2C.

As shown in FIG. 3, in some implementations, the tree cape 100 comprises one or more sleeve portions 110, 111, a neck portion 120, and one or more openings 130, 131. For example, in some implementations, the tree cape 100 comprises a first sleeve portion 110, a second sleeve portion 111, a neck portion 120, a first opening 130, and a second opening 131.

As shown in FIG. 2A and described below, in some implementations, the tree cape 100 may further comprise trim 102.

In some implementations, the components of the tree cape 100 are composed of a single piece of material 101. In some implementations, one or more of the components of the tree cape 100 are composed of separate pieces of material 101 attached or connected together to form the tree cape 100. In some implementations, the components of the tree cape 100 may be composed of any other suitable configuration of material 101.

As shown in FIG. 3, in some implementations, the sleeve portions 110, 111 each comprise a rectangular or generally rectangular (e.g., semi-rectangular) shaped portion of the material 101. In some implementations, the sleeve portions 110, 111 may each comprise any other suitable shaped portion of the material 101.

In some implementations, the sleeve portions 110, 111 are connected on opposite (or generally opposite) sides of the neck portion 120. In some implementations, the sleeve portions 110, 111 narrow or taper together to form the neck portion 120 in between the sleeve portions 110, 111. In some implementations, the sleeve portions 110, 111 extend in opposite (or generally opposite) directions from the neck portion 120. The neck portion may be the outer boundary near the cutout.

As shown in FIG. 3, in some implementations, the sleeve portions 110, 111 form the first opening 130 and the second opening 131 For example, in some implementations, the openings 130, 131 are formed by cutouts of the material 101 on opposite (or generally opposite) sides of the tree cape 100 between the sleeve portions 110, 111.

In some implementations, the sleeve portions 110, 111 are each configured to drape over a portion of a Christmas tree 10 when the tree cape 100 is installed on the tree 10, as described below. For example, in some implementations, the sleeve portions 110, 111 are each configured to hang down respectively on opposite (or generally opposite) sides of a tree 10 similar to how a cape hangs down when worn by a person. In some implementations, the sleeve portions 110, 111 are each configured to hang down such that the openings 130, 131 reveal at least part of the tree 10 through the tree cape 100.

As shown in FIG. 3, in some implementations, the neck portion 120 comprises a narrowed or tapered portion of the material 101 that extends between the sleeve portions 110, 111. In some implementations, the neck portion 120 also extends partly between the openings 130, 131.

The tree cape 100 is configured to be installed on a Christmas tree 10 by being wrapped over the tree 10 from the neck portion. In some implementations, this thereby allows the neck portion 120 to be wrapped around the tree 10 to install the tree cape 100.

In some implementations, the neck portion 120 is configured to be wrapped at least partly around a Christmas tree 10. For example, as described more below, in some implementations, the neck portion 120 is configured to be wrapped at least partly around an upper part of a tree 10 such that the tree cape 100 is installed on the tree 10.

As shown in FIG. 3, in some implementations, the openings 130, 131 comprise cutouts in the material 101 that are opposite or generally opposite each other. In some implementations, the openings 130, 131 are defined or bounded respectively by the sleeve portions 110, 111 and the neck portion 120.

As shown in FIGS. 2B and 3, in some implementations, the tree cape 100 comprises two openings 130, 131. In some implementations, the tree cape 100 may comprise one opening (e.g., the first opening 130). In some implementations, the tree cape 100 may comprise more than two openings.

In some implementations, the openings 130, 131 are configured to at least partly reveal a Christmas tree 10 through the tree cape 100 while the tree cape 10 is installed on the tree 10. For example, in some implementations, the openings 130, 131 are configured to at least partly display the tree 10 and/or decorations on the tree 10. In some implementations, the openings 130, 131 are configured to allow access to the tree 10 through the tree cape 100.

Figure 4A:
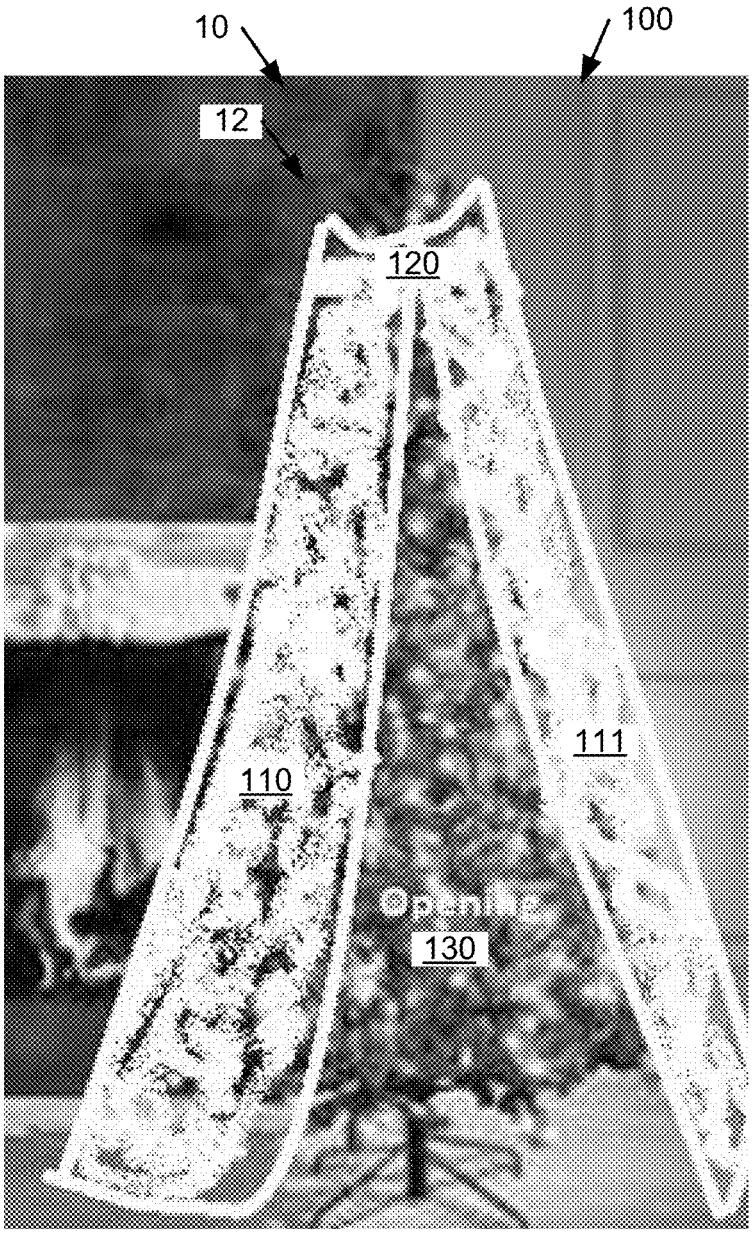
FIGS. 4A-4E illustrate example uses of the tree cape illustrated in FIGS. 2A-2C.
Figure 4B:
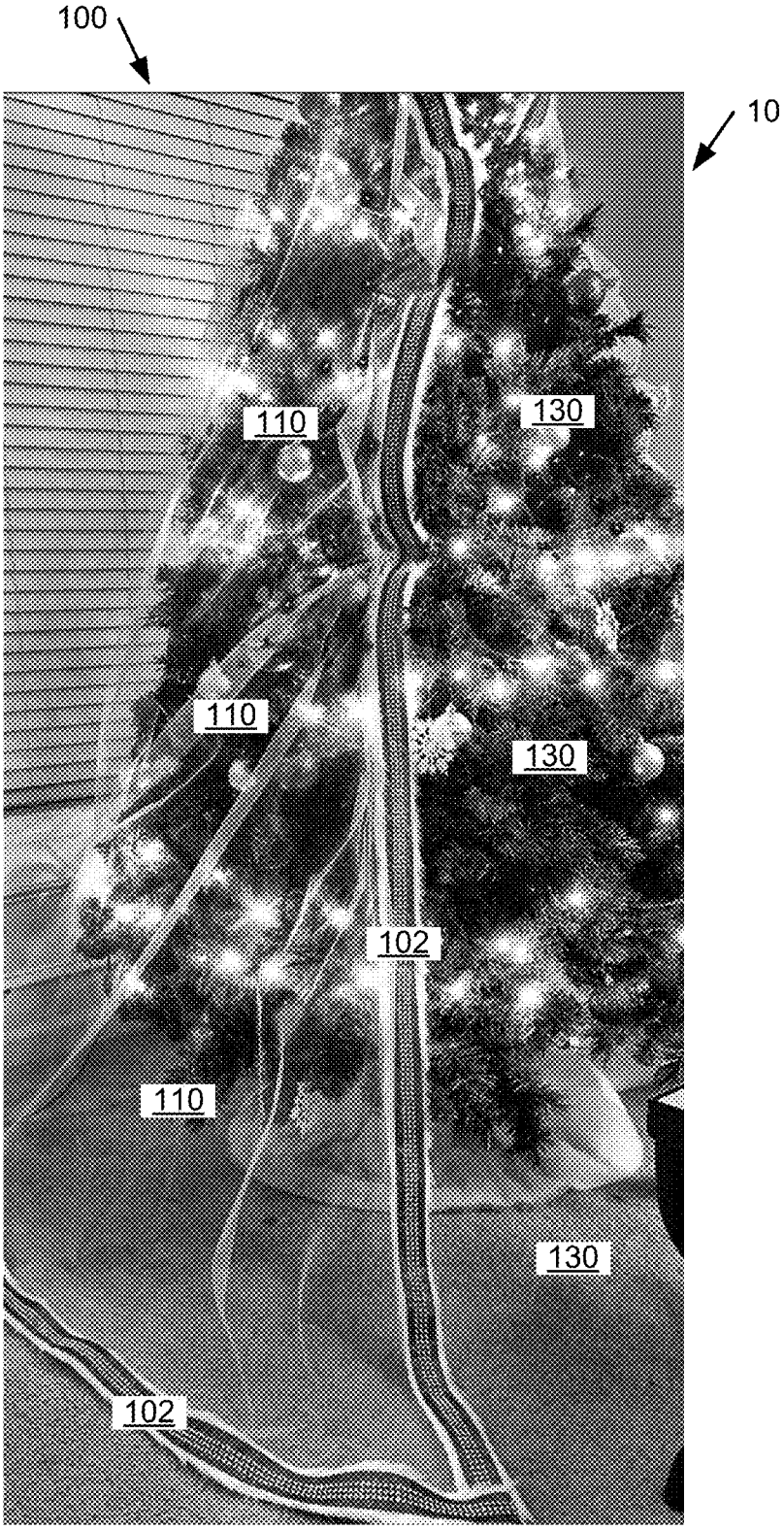

In some implementations, one or more of the openings 130, 131 may be configured to be at least partly closed. For example, as shown in FIG. 4E, in some implementations, the openings 130, 131 may be at least partly closeable with fasteners or closures 132, which may be separate from or integrated to the tree cape 100.

Figure 4C:
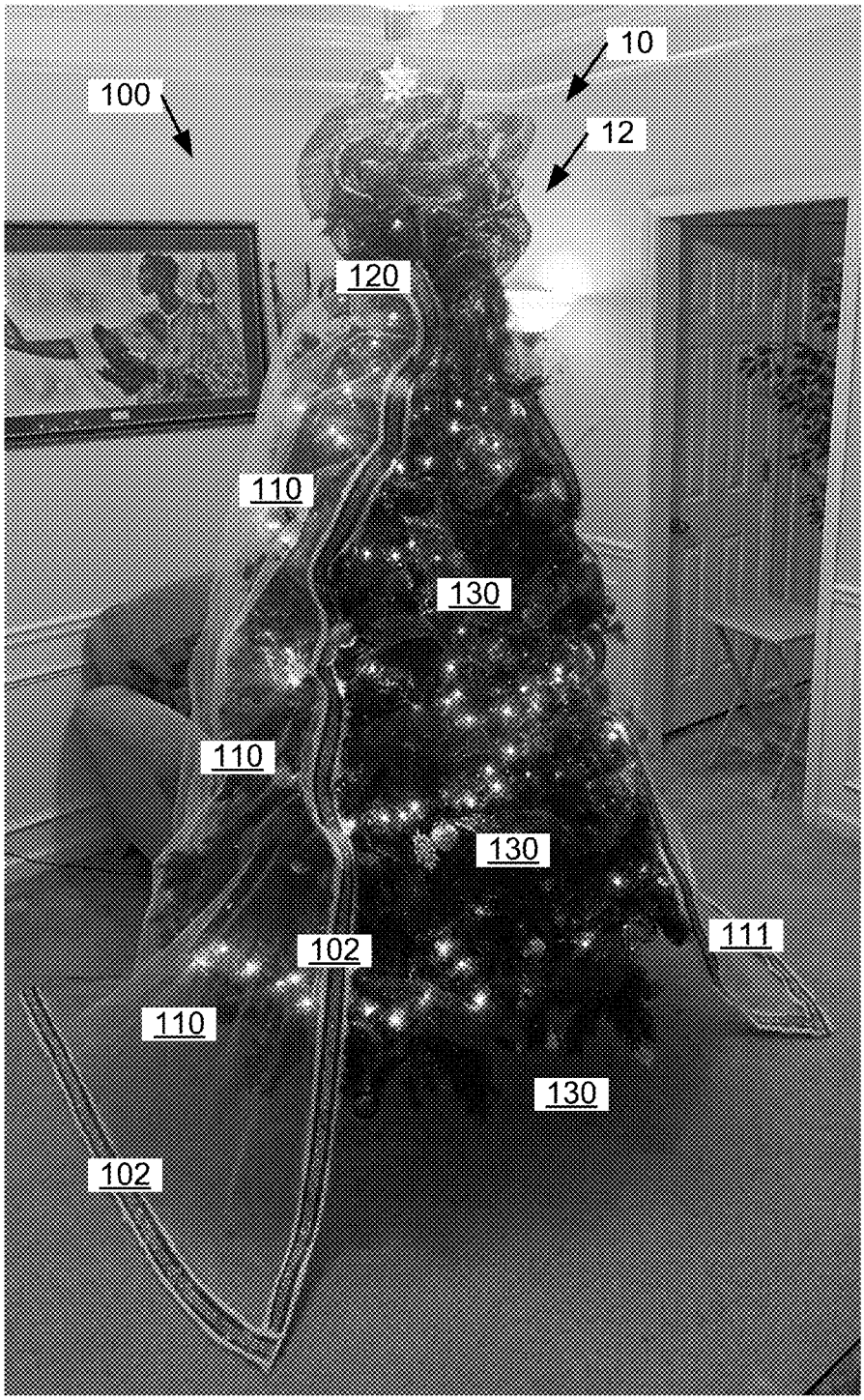
Figure 4D:
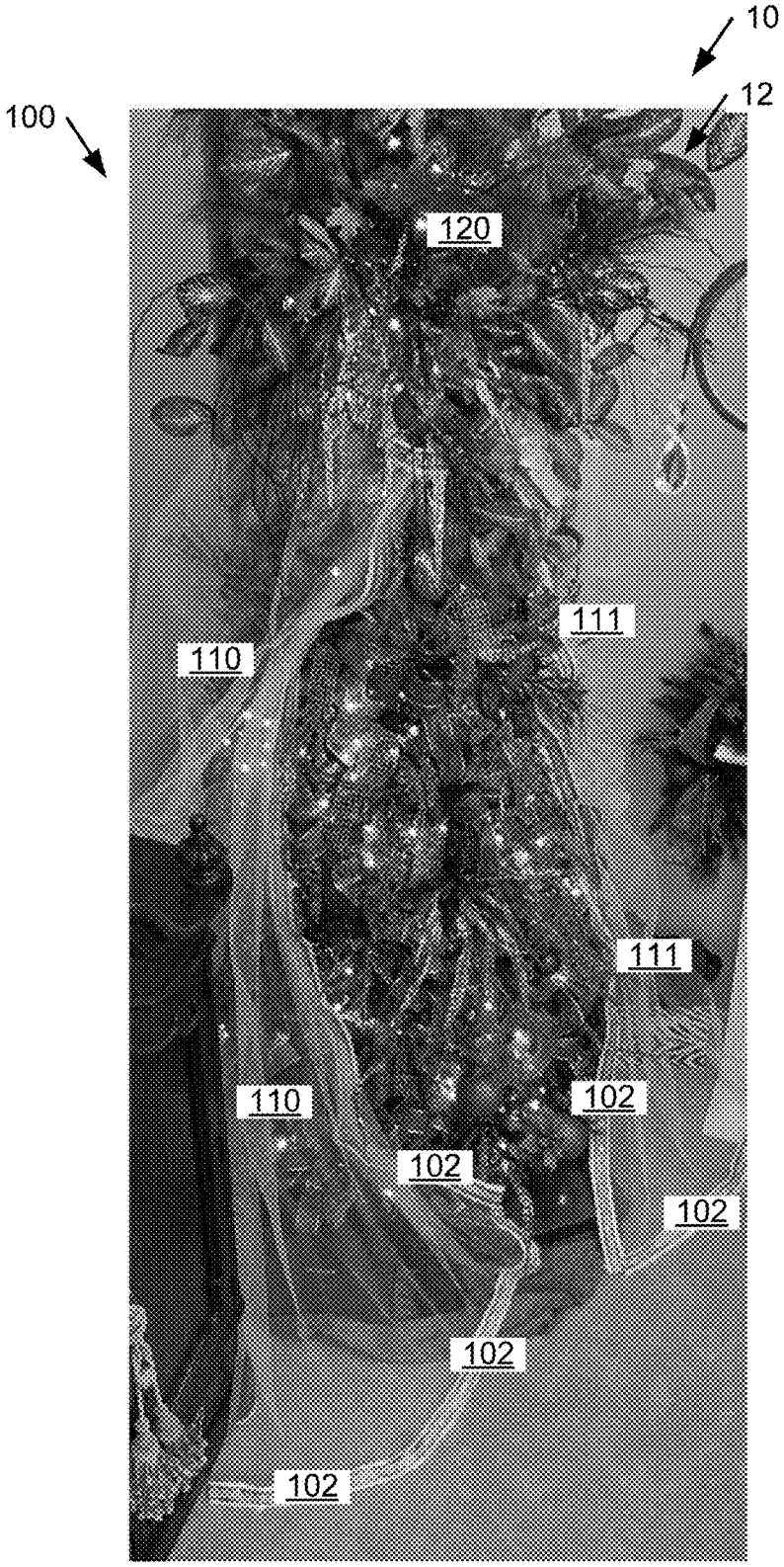
Figure 4E:
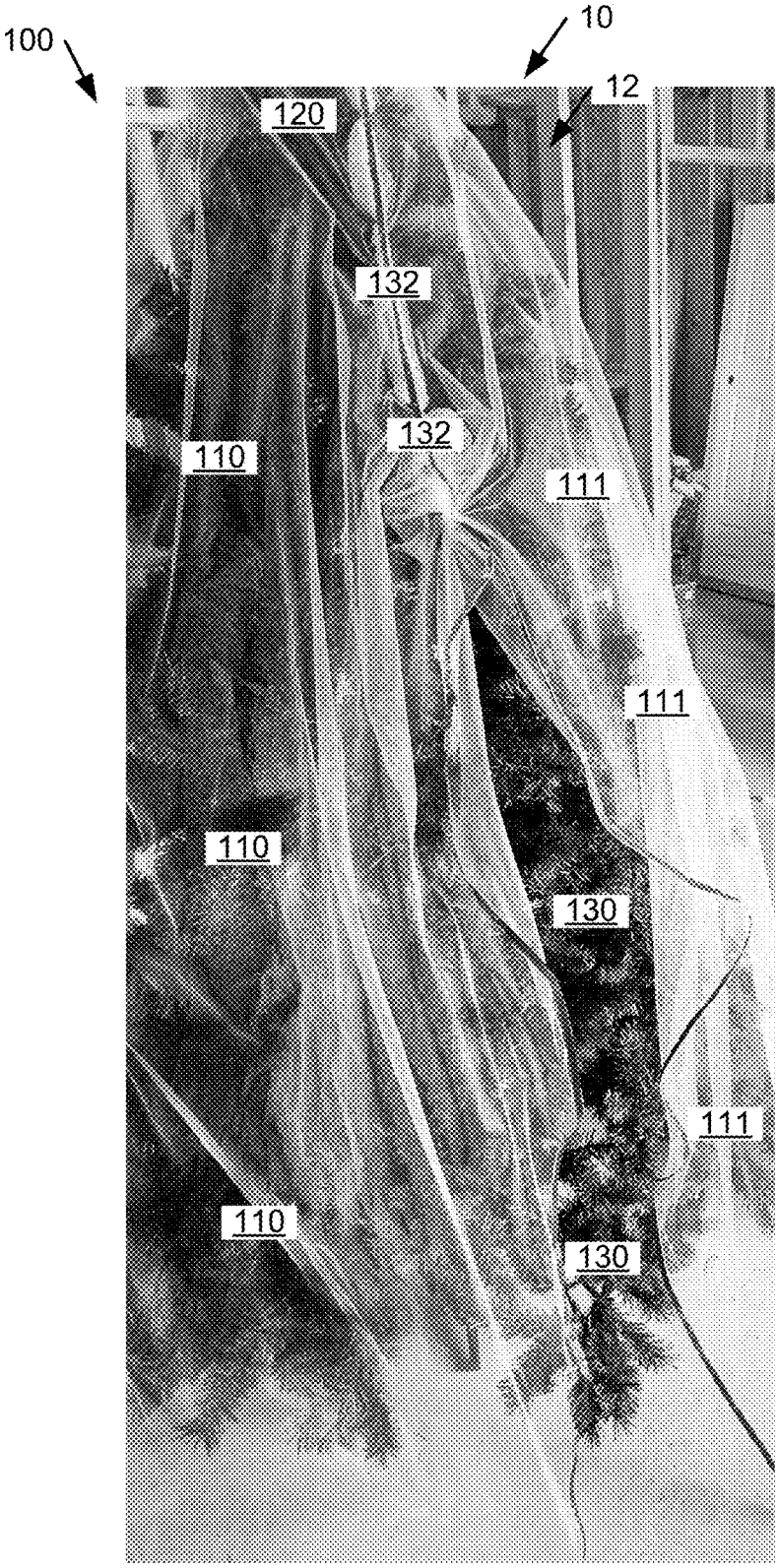
Figure 5A:
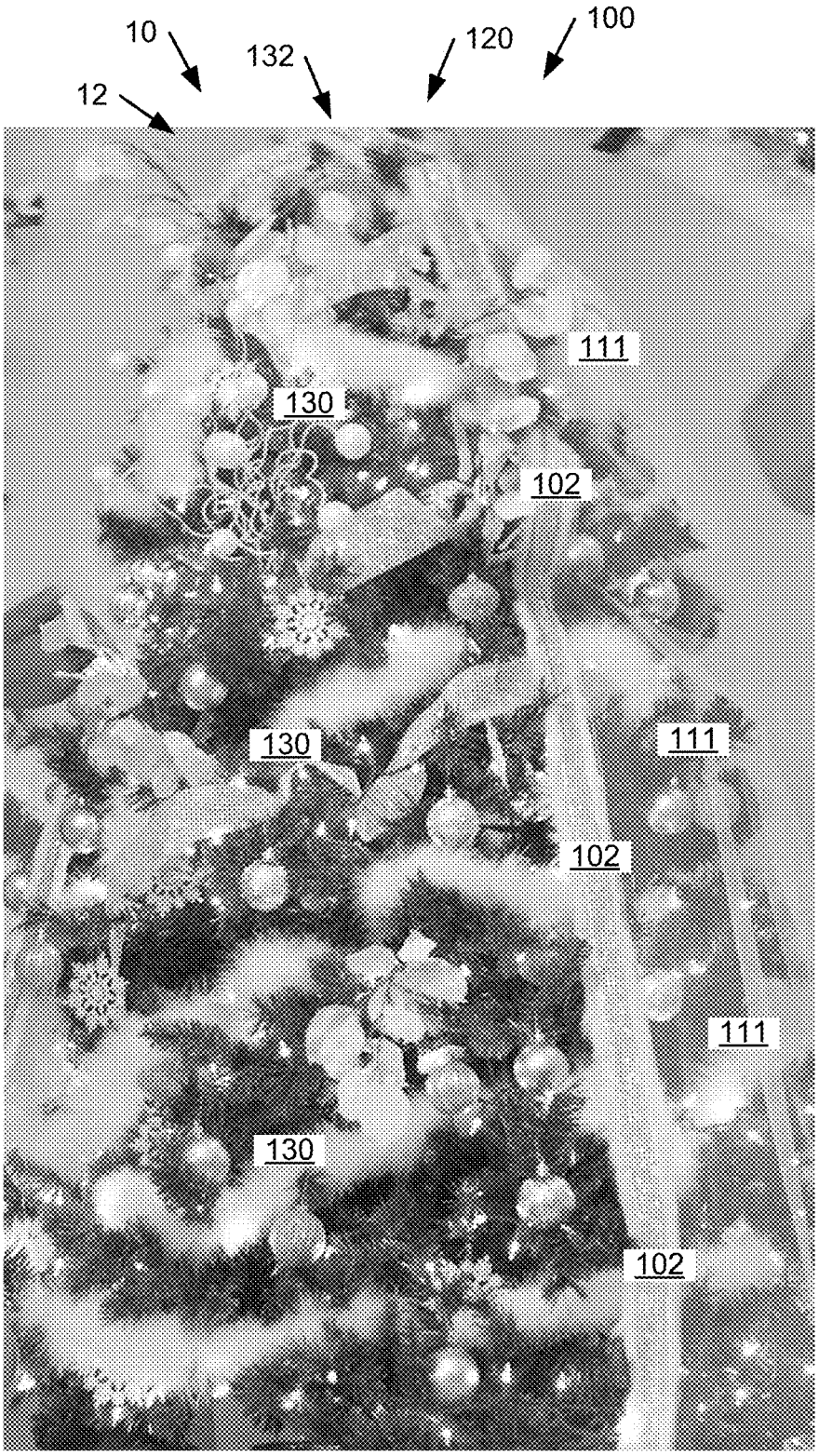
FIGS. 5A-5H illustrate additional example uses of the tree cape illustrated in FIGS. 2A-2C.
Figure 5B:
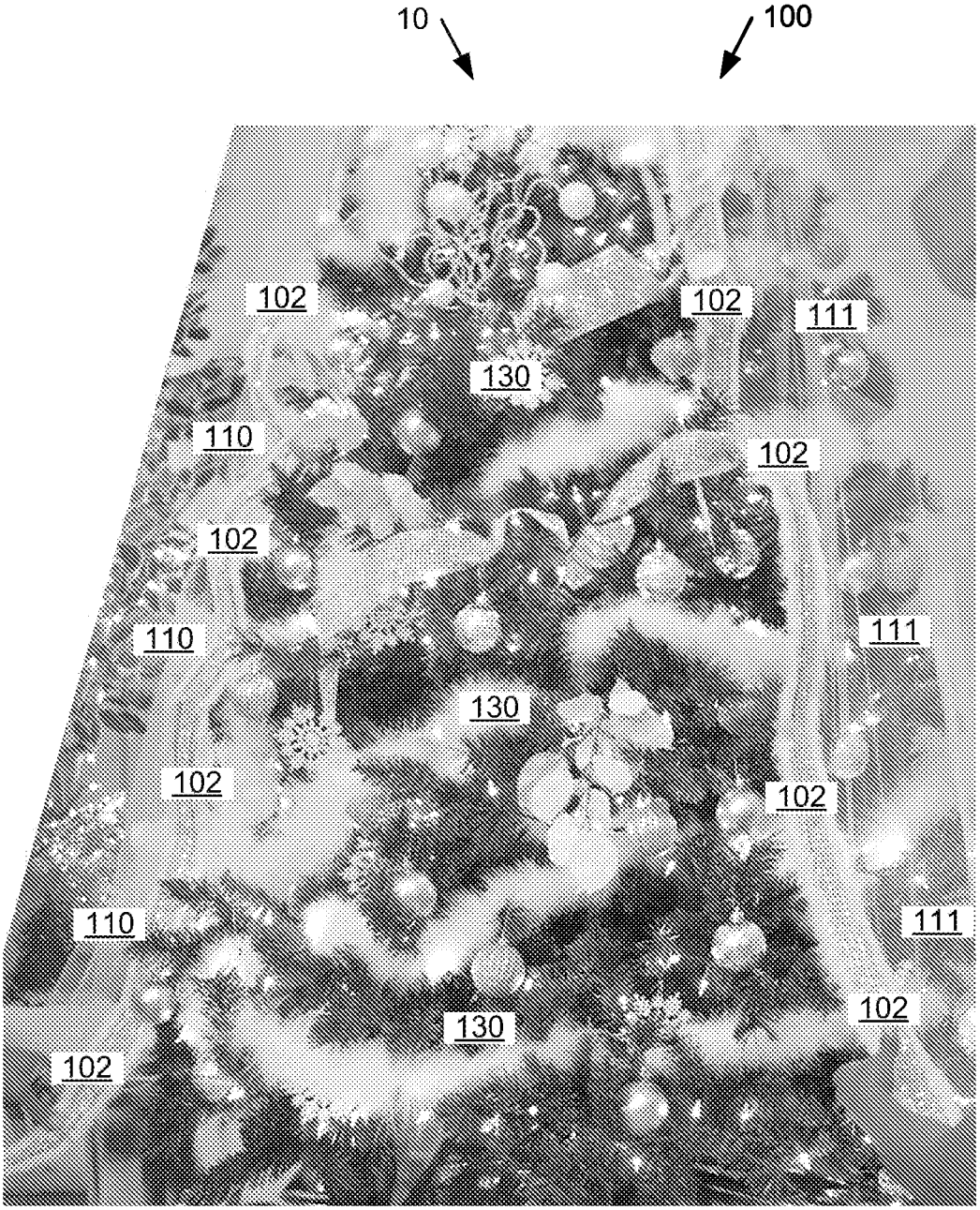
Figure 5C:
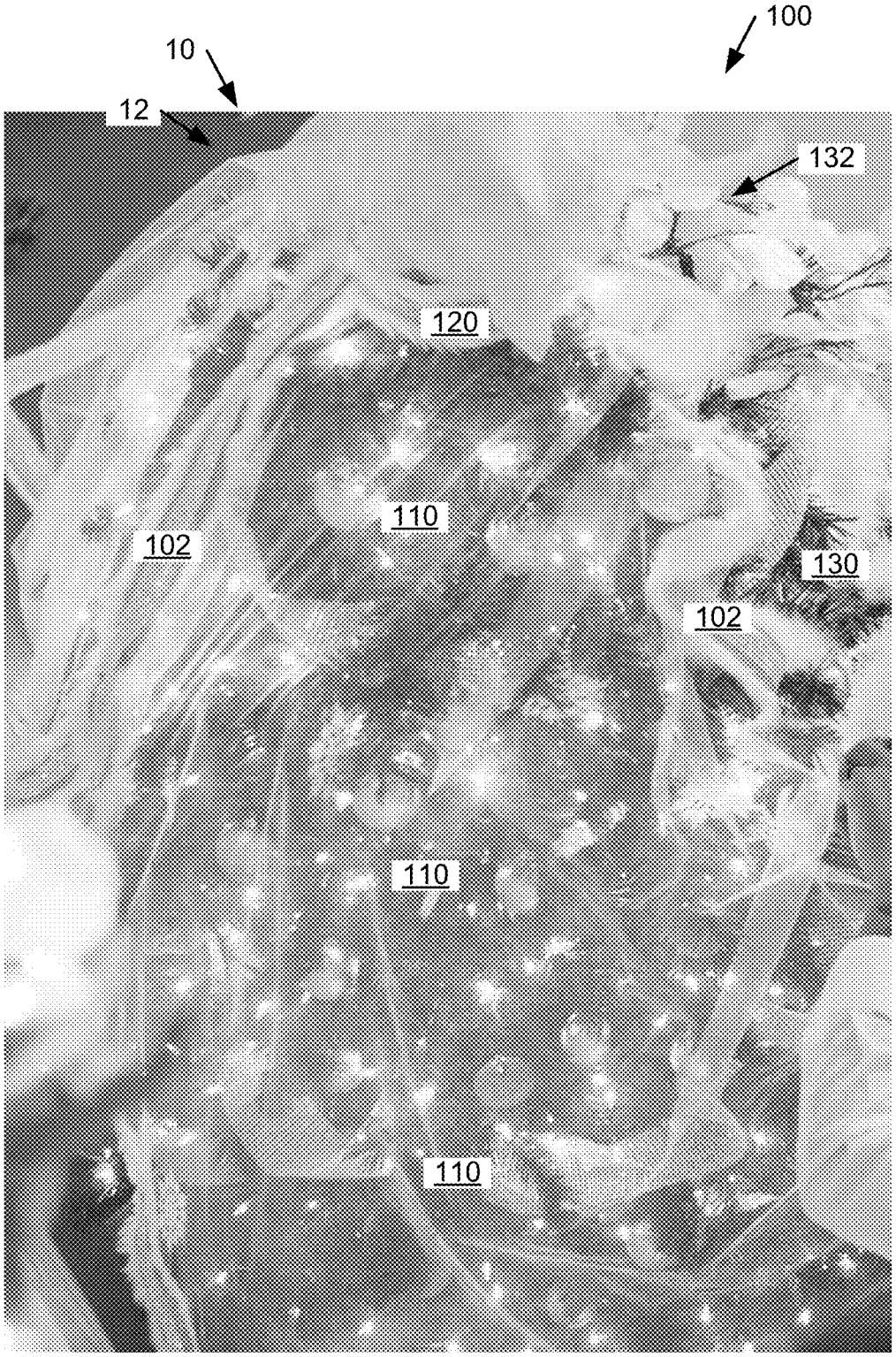
Figure 5D:
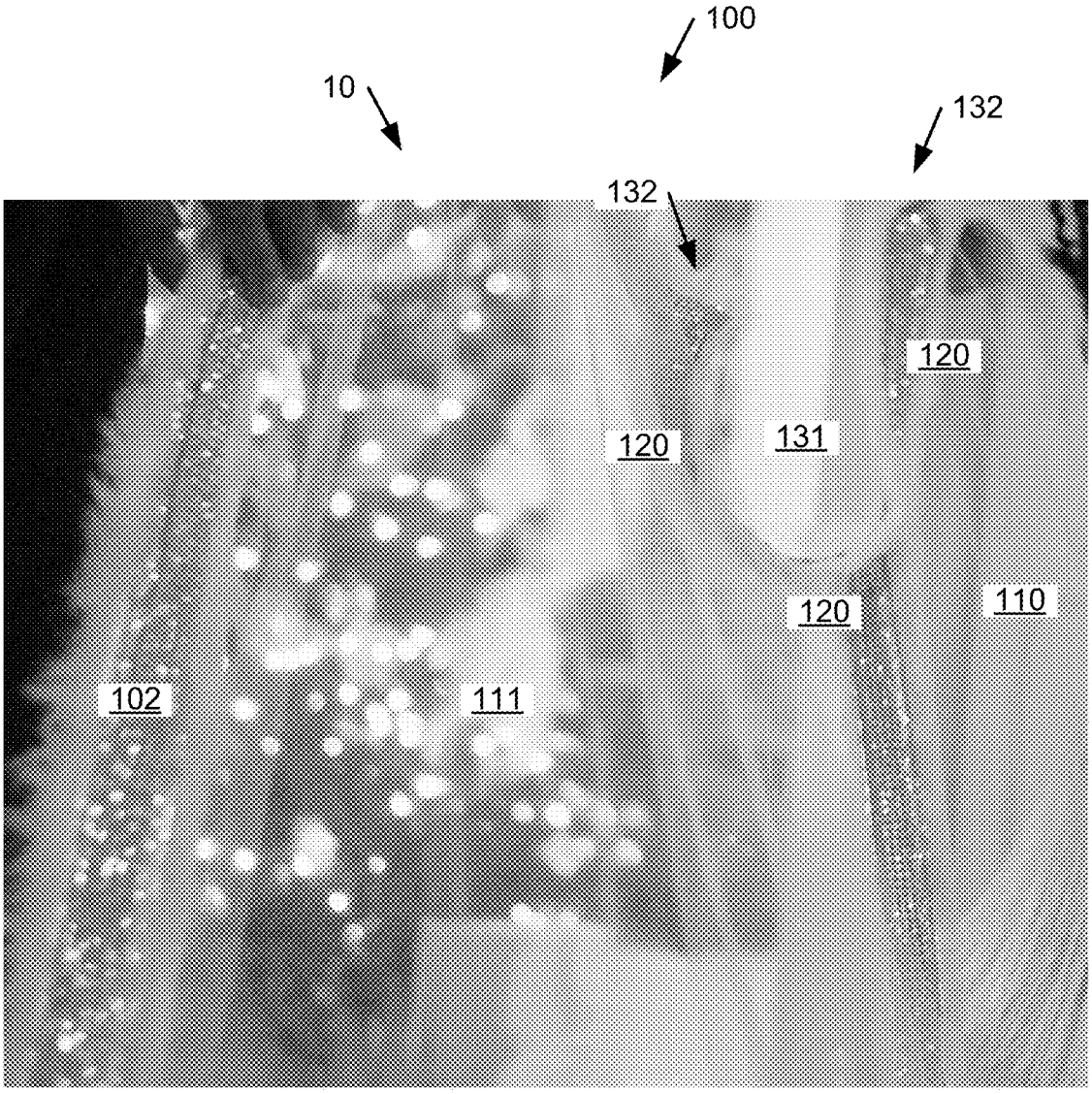
Figure 5E:
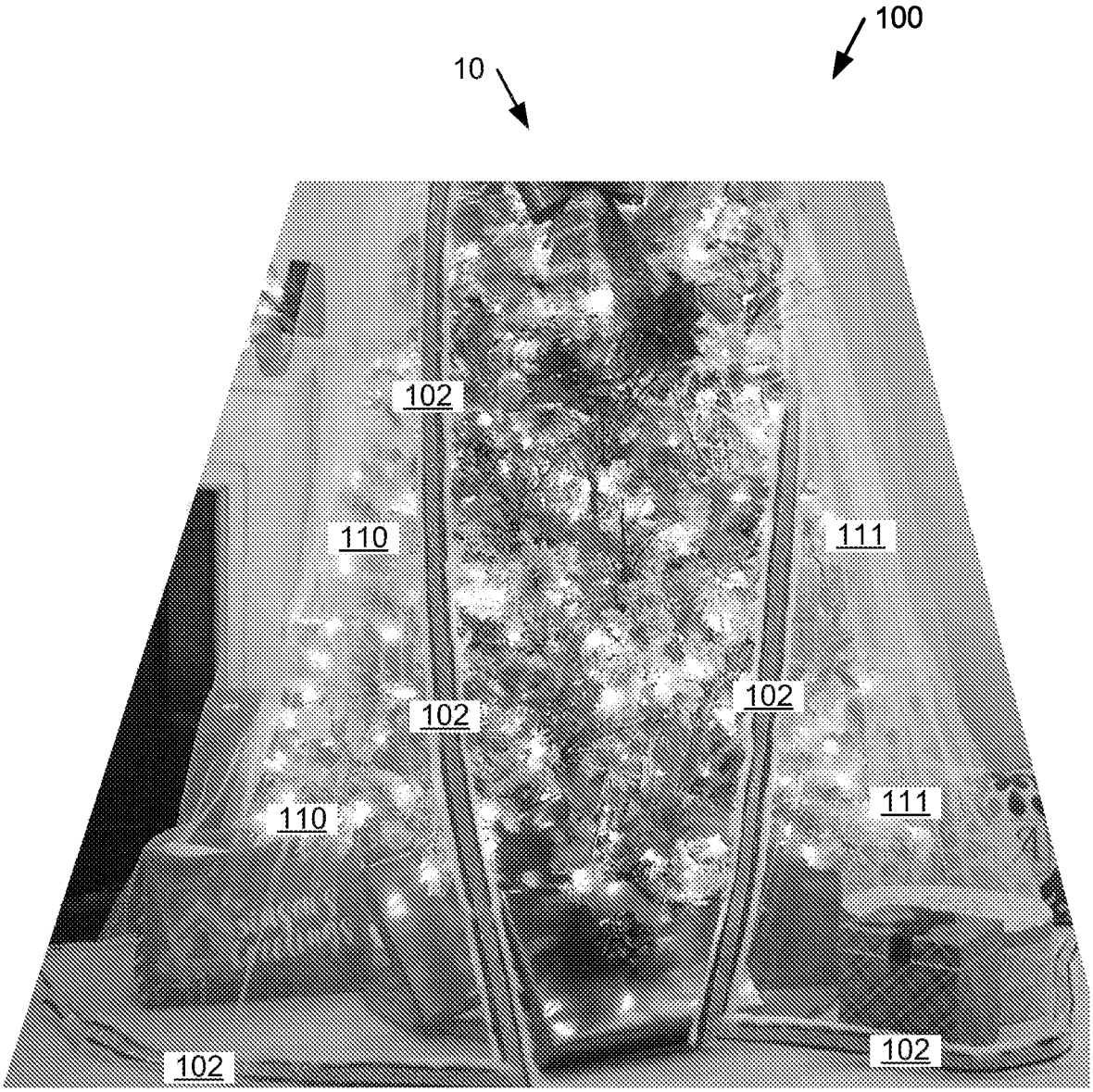
Figure 5F:
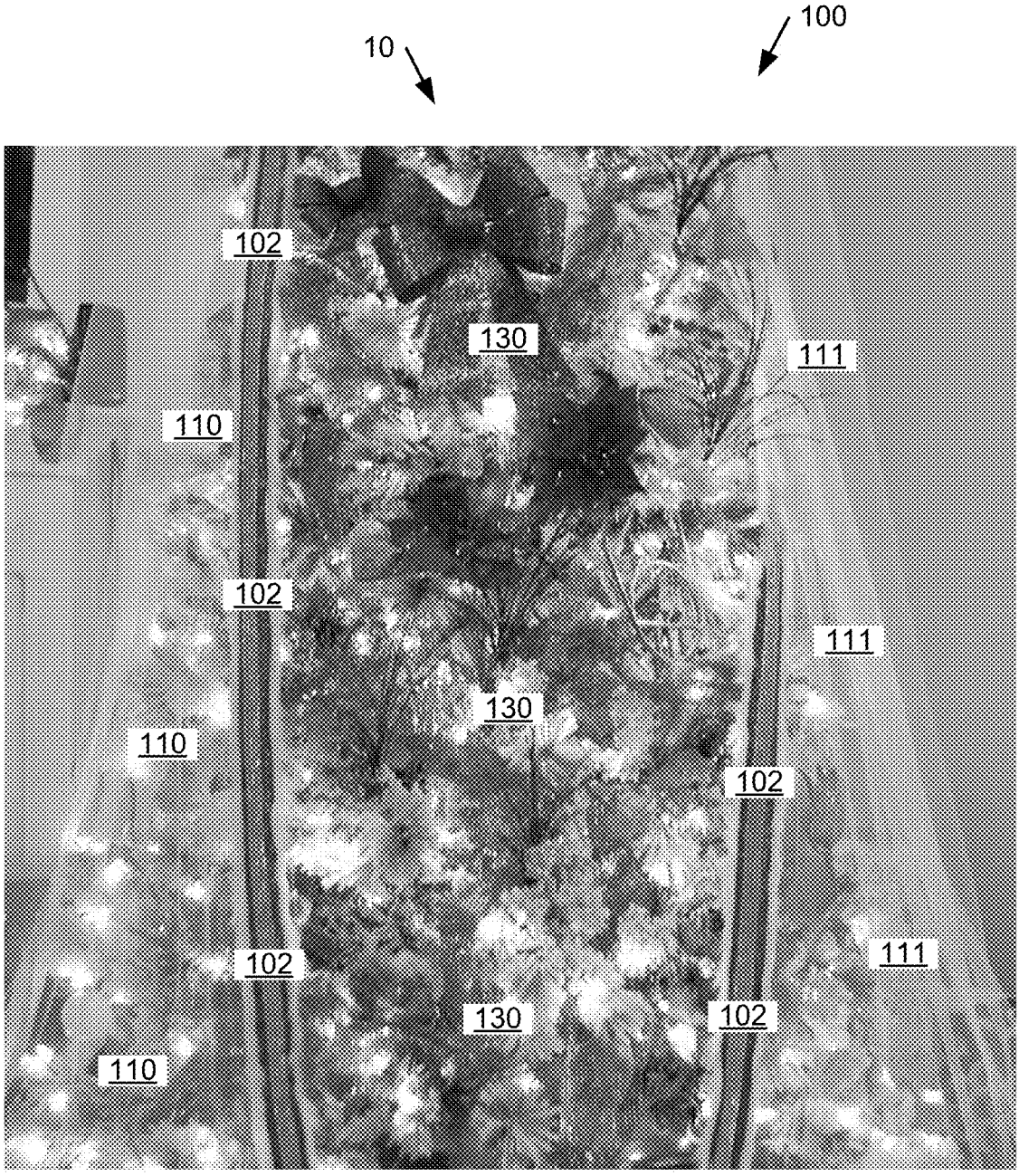
Figure 5G:
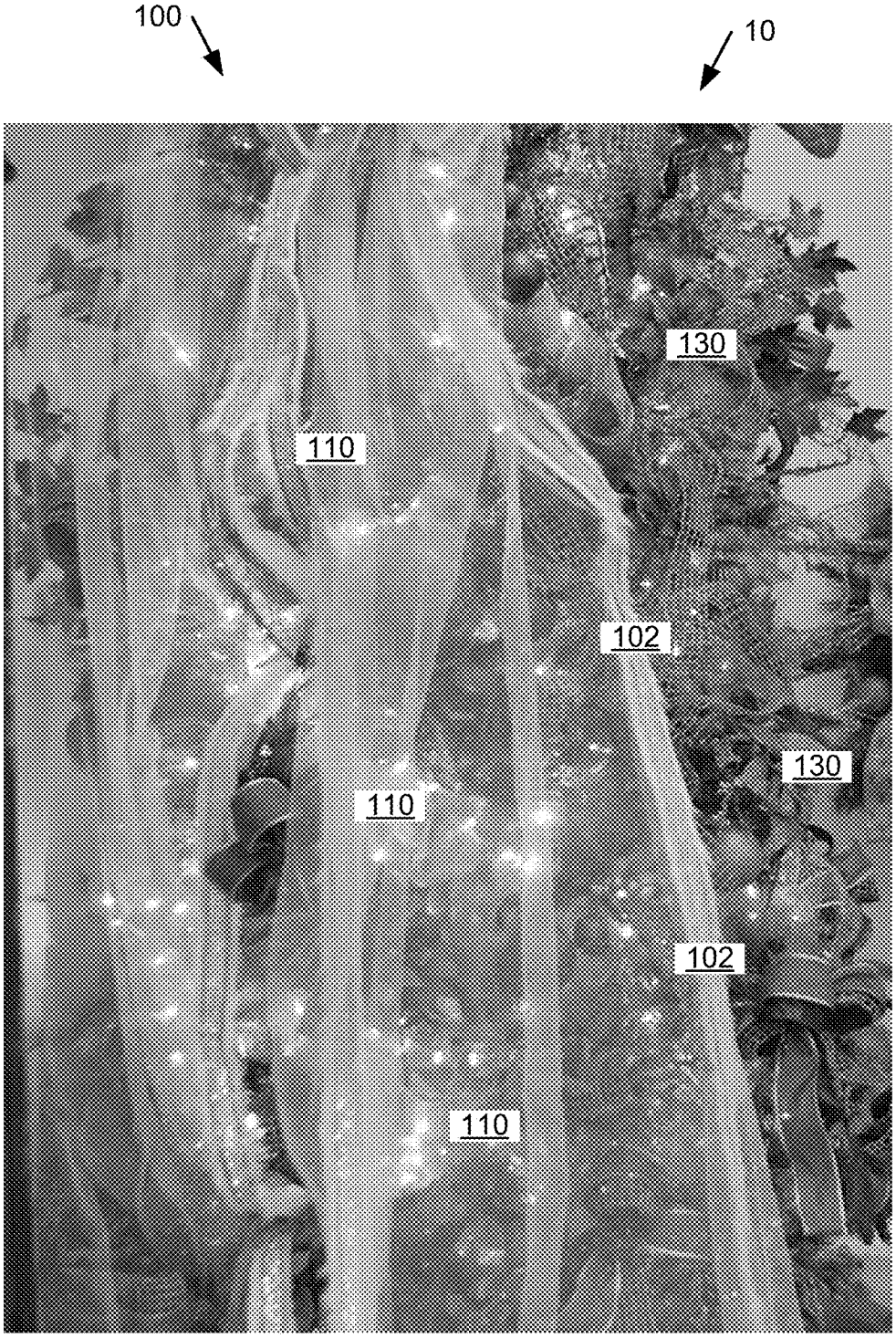
Figure 5H:
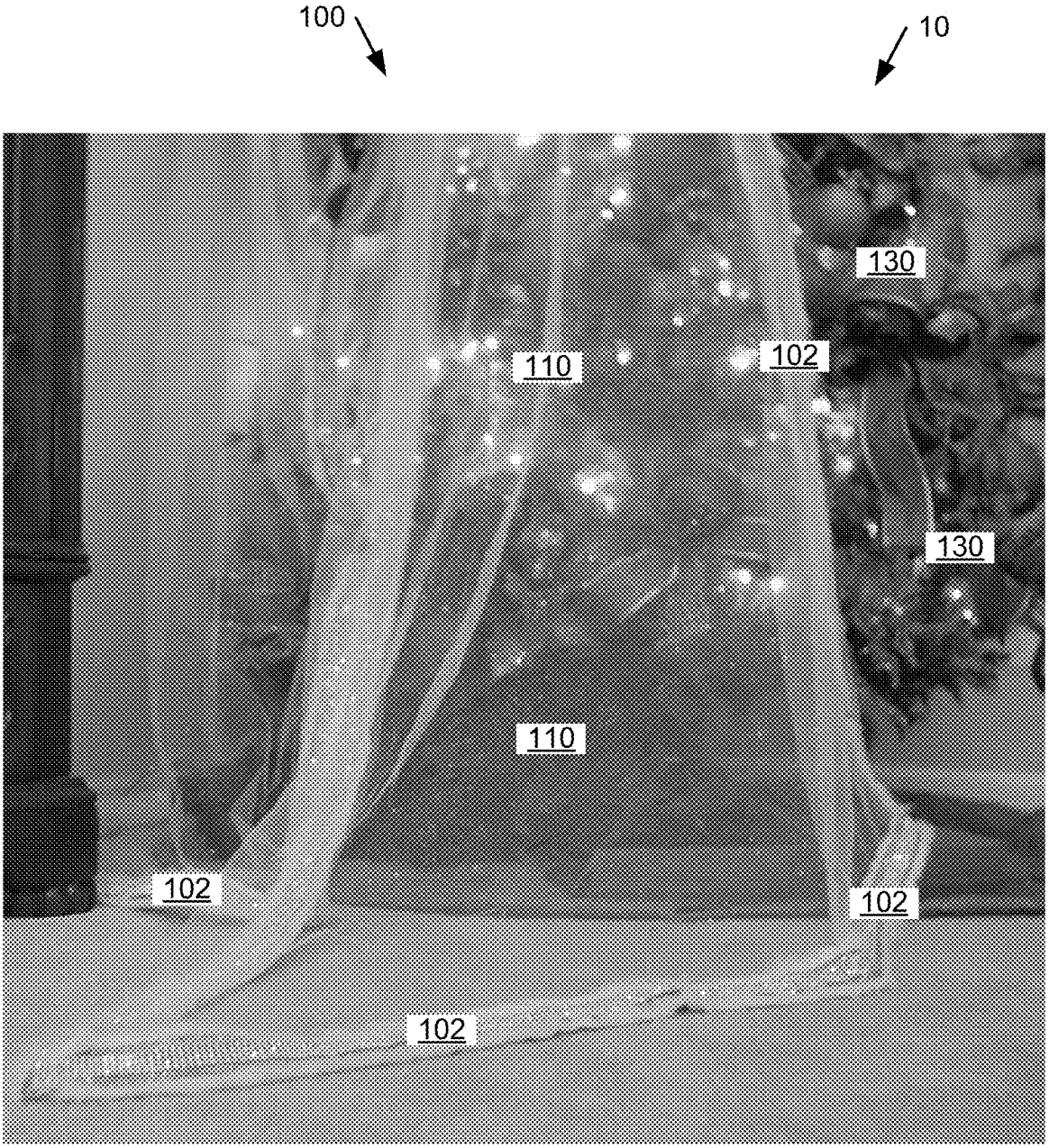

As introduced above and shown in FIGS. 2A and 4C, in some implementations, the tree cape 100 may further comprise a trim 102. For example, in some implementations, the trim 102 comprises an additional piece (e.g., strip) of material. In some implementations, the trim 102 may be attached along all or part of the perimeter (e.g., outer edges) of the tree cape 100.

As shown in FIGS. 2B and 4B, in some implementations, the trim 102 may comprise a decorative appearance. For example, in some implementations, the trim 102 may comprise a strip of material having an appearance of fur (e.g., faux fur) extending from opposite sides of the strip. In some implementations, the trim 102 may additionally or alternately comprise a jeweled design extending along the strip of material (e.g., in between the fur).

In some implementations, the trim 102 may comprise any other suitable features.

As shown in FIG. 3, in some implementations, the tree cape 100 comprises a rectangular or generally rectangular (e.g., semi-rectangular) shape, such as formed by the above described sleeve portions 110, 111, neck portion 120, and openings 130, 131. In some implementations, the tree cape 100 may comprise any other suitable shape. For example, in some implementations, the tree cape 100 may comprise any other suitable cape-like shape that can be placed on a tree 10 and/or function as described herein, e.g. similar to a cape that can be draped on a person.

In some implementations, the tree cape 100 is configured to provide a decorative cover to artificial (synthetic, faux, etc.) Christmas trees or similar trees, shrubs, etc. ("trees") 10, including real or non-artificial Christmas trees or other trees. In some implementations, the tree cape 100 is configured to provide such cover in a form that is similar to a clothing cape.

In some implementations, the tree cape 100 is configured to add or enhance a decorative appearance of such trees 10. In some implementations, the tree cape 100 is configured to provide such decorative appearance while showing at least a portion of such trees 10 through the material 101 composing the tree cape 100. In some implementations, the tree cape 100 is configured to provide such decorative appearance while showing at least a portion of such trees 10 through one or more openings 130, 131 of the tree cape 100.

In some implementations, the tree cape 100 may be configured to provide a protective cover to such trees 10, e.g. from dust, debris, moisture, etc. In some implementations, the tree cape 100 may be configured to provide such protective cover for non-use, storage, etc. of such trees 10.

In some implementations, the tree cape 100 may be configured to provide a concealing cover to such trees 10, e.g. to conceal or hide the trees 10 from view. In some implementations, the tree cape 100 may be configured to provide such concealing cover for non-use, storage, etc. of such trees 10.

In some implementations, the tree cape 100 comprises any suitable dimensions. For example, in some implementations, the tree cape 100 comprises dimensions that correspond to and/or are sufficient to provide such cover to trees 10 as described herein.

In some implementations, the tree cape 100 is composed of any suitable materials 101. For example, in some implementations, the tree cape 100 is composed of a natural, synthetic, or blended fabric material 101.

As shown in FIGS. 2A-2C and 4B-4E, in some implementations, the tree cape 100 is composed of material 101 that is sheer, translucent, and/or semi-transparent to allow trees 10 and/or decoration(s) on the trees 10 covered with the tree cape 100 to be seen through the material 101.

In some implementations, the tree cape 100 may be composed of material 101 that is repellant of dust, debris, moisture, etc. to protect trees 10 covered with the tree cape 100.

In some implementations, the tree cape 100 may be composed of material 101 that is opaque or otherwise concealing to conceal trees 10 covered with the tree cape 100.

In some implementations, the tree cape 100 can have any suitable appearance. For example, in some implementations, the tree cape 100 may comprise any suitable color, pattern, etc.

Figure 6:
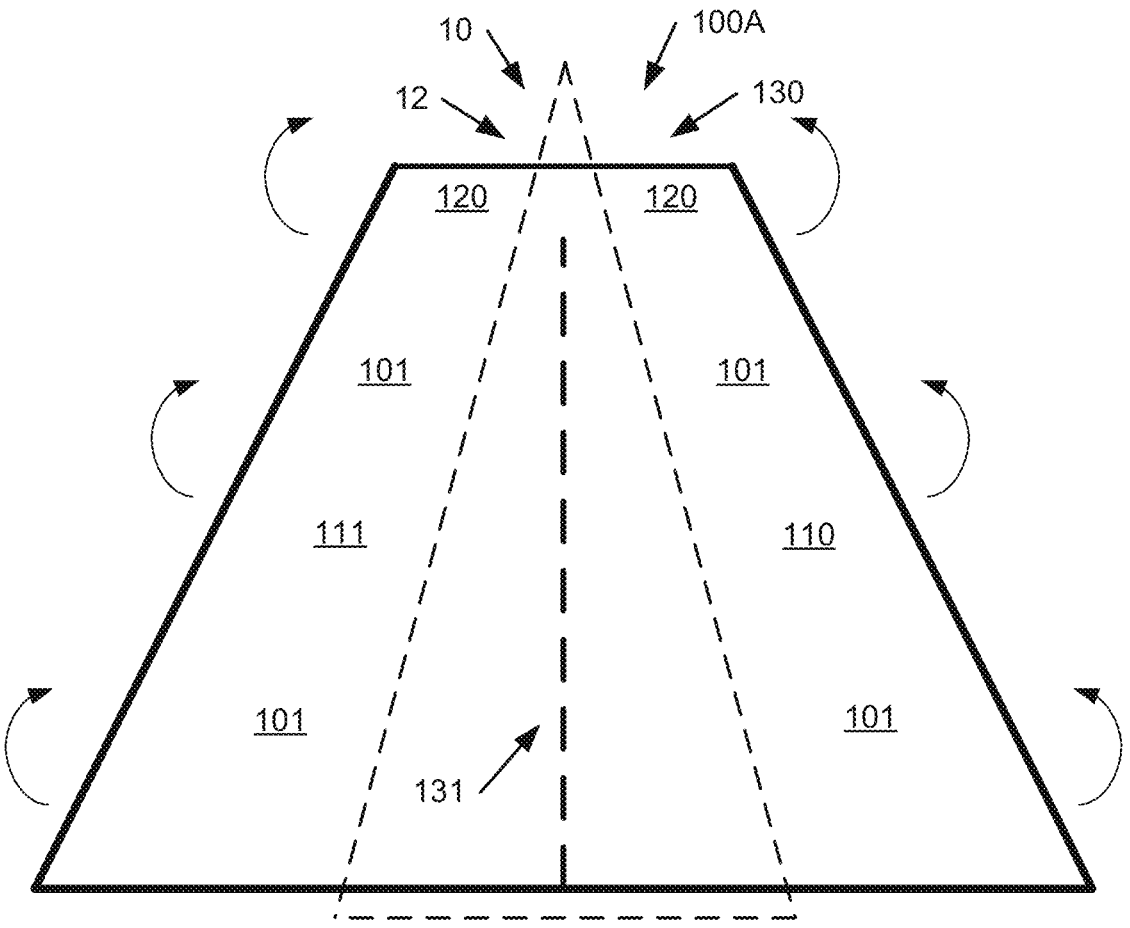
FIG. 6 illustrates another diagram representation of the example tree cape according to the present disclosure.

FIG. 6 illustrates another diagram representation of the example tree cape 100A according to the present disclosure. In some implementations, the tree cape 100A may be another or alternate implementation to the tree cape 100 shown in FIG. 3.

In some implementations, the tree cape 100A is generally the same or similar to the above described tree cape 100 of FIG. 3, as indicated by the like numbered features.

However, as shown in FIG. 6, in contrast to the tree cape 100 of FIG. 3, in some implementations, the tree cape 100A may not include a cutout forming the opening 130. Instead, in some implementations, the opening 130 is formed by the upper side of the material 101 adjacent to the neck portion 120.

As also shown in FIG. 6, in some implementations, the opening 131 may be formed by a split, slit, or separation in the material 101 instead of a cutout portion of the material 101.

As shown in FIG. 6, in some implementations, the neck portion 120 is sized and shaped such that the neck portion 120 at least partly positions around an upper portion 12 of a tree 10 and allows the tree cape 100A to hang or drape at least partly around the tree 10.

As also shown in FIG. 6, in some implementations, the material 101 is sized and shaped to hang or drape lengthwise and widthwise at least partly along the length and width of the tree 10.

FIGS. 4A-4E illustrate example uses of the tree cape 100 illustrated in FIGS. 2A-2C to cover trees 10 such as illustrated in FIG. 1. In some implementations, an example method of using the tree cape 100, with respect to the above-described figures, comprises positioning the neck portion 120 of the tree cape 100 at or adjacent to the top portion 12 of the tree 10, such as shown in FIG. 4C.

In some implementations, the neck portion 120 is positioned at or near the top 12 of the tree 10. In some implementations, the neck portion 120 may be positioned at any other suitable location on the tree 10.

In some implementations, the neck portion 120 is positioned on the tree 10 by positioning the neck portion 120 around the tree 10 from/through the first opening 131.

In some implementations, the method comprises further positioning the tree cape 100 over and around the tree 10. In some implementations, the neck portion is positioned and/or wrapped around the top portion 12 of the tree 10. In some implementations, the tree cape 100 is thereby secured to the tree 10 from the neck portion 120. In some implementations, the tree cape 100 may be further secured around the top portion 12 of the tree 10 by a fastener or closure (not shown).

In some implementations, the sleeve portions 110, 111 are positioned respectively around and over the tree 10 on opposite (or generally opposite) sides of the tree 10. In some implementations, the sleeve portions 110, 111 are positioned respectively to extend downward (e.g., drape) along the sides of the tree 10 from the neck portion 120 positioned at the top 12 of the tree 10.

In some implementations, the sleeve portions 110, 111 may be extended downward to at above the floor or other supporting surface of the tree 10. In some implementations, the sleeve portions 110, 111 may be extended downward to position/drape at least partly onto/along the floor or other supporting surface of the tree 10.

In some implementations, the tree cape 100 is finally/ultimately positioned such that the tree 10 and/or decoration(s) on the tree 10 are at least partly displayed through one or more of the openings 130, 131.

In some implementations, the above described positioning of the tree cape 100 on the tree 10 may be similar to positioning a cape over and around the shoulders of a wearer and securing the cape at the neck portion of the cape.

As shown in FIG. 4E, in some implementations, the method may further comprise at least partly closing one or more of the openings 130, 131 with fasteners or closures 132.

In some implementations, the method may further comprise removing the tree cape 100 from the tree 10 by unwrapping the neck portion 120 from the tree 10 and removing the sleeve portions 110, 111 from over and around the sides of the tree 10 (e.g., reversing the above described positioning of the tree cape 100 on the tree 10).

FIGS. 5A-5H illustrate additional example uses of the tree cape 100 illustrated in FIGS. 2A-2C to cover trees 10 such as illustrated in FIG. 1, such as by the method described above for FIGS. 4A-4E.

The figures, including photographs and drawings, comprised herewith may represent one or more implementations of the tree cape.

Details shown in the figures, such as dimensions, descriptions, etc., are exemplary, and there may be implementations of other suitable details according to the present disclosure.

Reference throughout this specification to "an embodiment" or "implementation" or words of similar import means that a particular described feature, structure, or characteristic is comprised in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations may be depicted in the drawings in a particular order, this should not be understood as requiring that such operations be performed in the particular order shown or in sequential order, or that all illustrated operations be performed, to achieve desirable results.

The invention claimed is:

1. An article of manufacture comprising an elongated piece of material having a first elongated side and a second elongated side, opposite the first elongated side wherein the piece of material includes a first cutout on the first elongated side and a second cutout, on the second elongated side, opposite the first cutout thereby forming a tree cape configured to drape a tree and having a neck portion and a plurality of sleeve portions extending from the neck portion in opposition directions, wherein the first cutout and the second cutout have different sizes thereby forming openings of different sizes;

wherein the neck portion is that edge of the piece of material formed by the first cutout and corresponds to an outer upper edge of the tree cape when the tree cape is placed on the tree and encircles an upper portion of a tree adjacent the top of the tree;

wherein a right sleeve portion of the tree cape corresponds to the right half of the elongated piece of material and the left sleeve portion of the tree cape corresponds to the left half of the elongated piece of material, wherein the elongated piece of material is sized lengthwise such that the right sleeve portion and the left sleeve portion extend from the neck portion to at least the floor or ground on which the tree stands when the tree cape is placed on the tree by encircling the neck portion around the upper portion of the tree adjacent the top of the tree, wherein the second cutout forms an opening between the sleeve portions such that the sleeve portions are separable from each other and when the tree cape is placed on the tree, at least a portion of the sleeve portions are separately adjustable to cover or reveal desired portions of the tree, and wherein the piece of material is at least semi-transparent to allow the tree to be seen through the material.

2. The article of manufacture of claim 1 wherein the neck portion comprises a fastener positioned such that the tree cape is fastenable around a Christmas tree between the first side and the second side of the tree cape when the tree cape is draped on the Christmas tree.

3. The article of manufacture of claim 1 wherein the piece of material further comprises a decorative trim extending at least partly along the perimeter of the piece of material such that the decorative trim is at least partly visible when the tree cape is draped on a Christmas tree.

4. A method of using an article of manufacture, wherein:

the article of manufacture comprises an elongated piece of material having a first elongated side and a second elongated side, opposite the first elongated side wherein the piece of material includes a first cutout on the first elongated side and a second cutout, on the second elongated side, opposite the first cutout thereby forming a tree cape configured to drape a tree and having a neck portion and a plurality of sleeve portions extending from the neck portion in opposition directions, wherein the first cutout and the second cutout have different sizes thereby forming openings of different sizes;

wherein the neck portion is that edge of the piece of material formed by the first cutout and corresponds to an outer upper edge of the tree cape when the tree cape is placed on the tree and encircles an upper portion of a tree adjacent the top of the tree;

wherein a right sleeve portion of the tree cape corresponds to the right half of the elongated piece of material and the left sleeve portion of the tree cape corresponds to the left half of the elongated piece of material, wherein the elongated piece of material is sized lengthwise such that the right sleeve portion and the left sleeve portion extend from the neck portion to at least the floor or ground on which the tree stands when the tree cape is placed on the tree by encircling the neck portion around the upper portion of the tree adjacent the top of the tree, wherein the second cutout forms an opening between the sleeve portions such that the sleeve portions are separable from each other and when the tree cape is placed on the tree, at least a portion of the sleeve portions are separately adjustable to cover or reveal desired portions of the tree, wherein the piece of material is at least semi-transparent to allow the tree to be seen through the material; and the method comprises:

encircling the neck portion around the upper portion of the tree adjacent to the top of the tree; and extending each sleeve portion lengthwise from the neck portion to at least the surface on which the tree stands to cover portions of the tree on a right side and left side of the tree respectively.

5. The method of claim 4 further comprising separately adjusting the sleeve portions to adjust the opening of the second cutout to cover or not cover desired portions of the tree.

6. A method of using an article of manufacture, wherein:

the article of manufacture comprises an elongated piece of material having a first elongated side and a second elongated side, opposite the first elongated side wherein the piece of material includes a first cutout on the first elongated side and a second cutout, on the second elongated side, opposite the first cutout thereby forming a tree cape configured to drape a tree and having a neck portion and a plurality of sleeve portions extending from the neck portion in opposition directions, wherein the first cutout and the second cutout have different sizes thereby forming openings of different sizes;

wherein the neck portion is that edge of the piece of material formed by the first cutout and corresponds to an outer upper edge of the tree cape when the tree cape is placed on the tree and encircles an upper portion of a tree adjacent the top of the tree;

wherein a right sleeve portion of the tree cape corresponds to the right half of the elongated piece of material and the left sleeve portion of the tree cape corresponds to the left half of the elongated piece of material, wherein the elongated piece of material is sized lengthwise such that the right sleeve portion and the left sleeve portion extend from the neck portion to at least the floor or ground on which the tree stands when the tree cape is placed on the tree by encircling the neck portion around the upper portion of the tree adjacent the top of the tree, wherein the second cutout forms an opening between the sleeve portions such that the sleeve portions are separable from each other and when the tree cape is placed on the tree, at least a portion of the sleeve portions are separately adjustable to cover or reveal desired portions of the tree, wherein the piece of material is at least semi-transparent to allow the tree to be seen through the material;

a fastener is positioned on the neck portion such that the tree cape is fastenable around the tree when the tree cape is placed on the tree; and a decorative trim extending at least partly along the perimeter of the piece of material such that the decorative trim is at least partly visible when the tree cape is placed on the tree; and the method comprises:

encircling the neck portion around the upper portion of the tree adjacent to the top of the tree; and extending each sleeve portion lengthwise from the neck portion to at least the surface on which the tree stands to cover portions of the tree on a right side and left side of the tree respectively.

7. The method of claim 6 further comprising separately adjusting the sleeve portions to adjust the opening of the second cutout to cover or not cover desired portions of the tree.

8. The method of claim 6 further comprising fastening the tree cape around the tree at the neck portion by the fastener.

* * * * *